US005184987A

United States Patent [19]

Wilkinson

[11] Patent Number: 5,184,987

[45] Date of Patent: Feb. 9, 1993

[54] AEROBIC CLIMBING STEP/BENCH

[76] Inventor: William T. Wilkinson, P.O. Box 378, Chesapeake City, Md. 21915

[21] Appl. No.: 698,382

[22] Filed: May 10, 1991

[51] Int. Cl.[5] ..... A63B 71/00

[52] U.S. Cl. ..... 482/52; 297/438

[58] Field of Search ..... 482/52; 297/438, 439; 108/53.1, 53.3, 91, 43, 157; 248/188.2, 188.3, 188.9

[56] References Cited

U.S. PATENT DOCUMENTS 744,287 11/1903 Brasel ..... 248/118.3

4,678,234 7/1987 Wilson ..... 297/439

*Primary Examiner*—John J. Wilson

*Assistant Examiner*—L. Thomas

*Attorney, Agent, or Firm*—Connelly & Hutz

[57] ABSTRACT

An aerobic climbing step/bench includes a base in the form of a horizontal platform having a downwardly extending apron. Height adjustability is achieved by the use of detachable legs which are mounted to the base by the interengagement of mounting elements on each leg and complementary mounting elements on the base so that the legs can be slideably engaged in a locking position with the base and slideably detached from the base.

12 Claims, 5 Drawing Sheets

AEROBIC CLIMBING STEP/BENCH

BACKGROUND OF INVENTION

Various devices exist for use in aerobic exercise programs. One type of device which has met with great success is a bench or step for aerobic step climbing. For example, I have developed a form of single step climbing during which the user would repeatedly step up and down from a single step. An important feature for making the device capable for widespread appeal to permit it to be customized to the needs of the particular user is height adjustability. In my U.S. Pat. No. 4,340,218 I disclose one manner of achieving this height adjustability. Other later patents and applications of mine disclose useful variations for accomplishing that result.

SUMMARY OF INVENTION

An object of this invention is to provide an aerobic climbing step/bench which is compact and lightweight and capable of being stored and transported.

A further object of this invention is to provide such a device which may offer a wide variety of incremental heights that are easily and quickly adjustable to accommodate the needs of a particular user.

A further object of this invention is to provide such a device which may be mass produced inexpensively in a simple design.

In accordance with one embodiment of this invention, the aerobic climbing step/bench device includes a base which is in the form of a horizontal platform having a downwardly extending apron. Height adjustability is achieved by the provision of legs which include mounting elements for engagement with complementary mounting elements on the base. In one practice of the invention, the engagement is achieved by a horizontal, sliding engagement of the legs into and out of their mounting position.

The legs and base may include multiple sets of mounting elements so that height adjustment is achieved in accordance with the sets of mounting elements being utilized. Alternatively, height adjustment could be achieved by providing plural sets of legs which are attached to each other to raise or lower the platform. A mat may also be provided which could be used for the lowest height in an aerobic exercise program or could be used for achieving the greatest height by placing the base and its attached legs on top of the mat.

THE DRAWINGS

DETAILED DESCRIPTION

Figure 1:
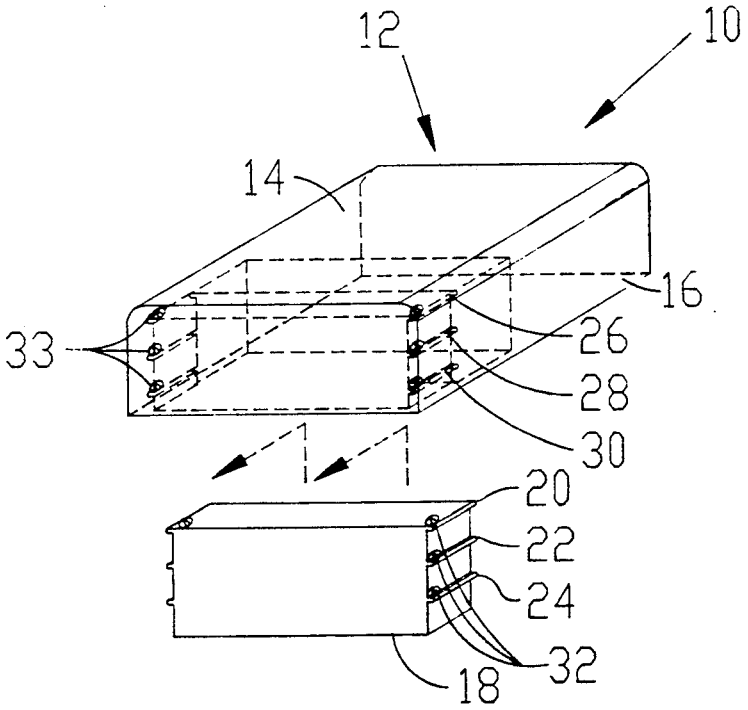
FIG. 1 is a perspective assembly view showing an aerobic climbing step/bench in accordance with my invention wherein one of a pair of legs is to be mounted to a base.

FIG. 1 illustrates an aerobic climbing step/bench device 10 in accordance with this invention. As shown therein device 10 includes a base 12 having a horizontal platform 14 with a downwardly extending apron 16. Apron 16 may extend completely around the periphery of platform 14 or may extend only in areas where support is needed. As shown in FIG. 1 height adjustability is achieved through a pair of steps 18 only one of which is illustrated. The other step would be of identical construction. Step 18 is provided with a series of vertically displaced mounting elements 20, 22, 24 on each side thereof. In the illustrated embodiment the mounting elements are in the form of ridges or tongues which fit in corresponding grooves or tracks on opposite sides 26, 28, 30 on the inner surface of apron 16. One set of such grooves or tracks is illustrated at one end of apron 16 and a second set would be provided at the other end of apron 16. Each leg 18 is of a length which is no greater than $\frac{1}{3}$ the length of base 14 so that the corresponding tracks 26, 28, 30 could extend at each end of apron 16 and occupy about a $\frac{1}{3}$ of its length in each location thereof. Thus, a central portion of apron 16 is free of tracks so that each leg may be mounted to base 12 by being inserted upwardly in the central portion of the base between the opposite sides of apron 16. Base 12 is preferably inverted to permit the legs to be mounted. Alternatively, base 12 could be raised without inversion and each leg sequentially moved vertically into the trackless central section of apron 16. Each leg 18 would then be moved outwardly toward the outer end of platform 14 with the various ridges engaged in the complementary tracks of base 12. Preferably, each ridge is provided with a projection such as a nub or dimple 32 which would fit in a corresponding notch 33 in its respective track to lock the leg in place when the leg is disposed at its most outward position. In the preferred practice of this invention a pair of legs 18 would be provided for base 12. The invention, however, may be practiced with any number of legs as long as the desired stability is achieved.

Figure 3:
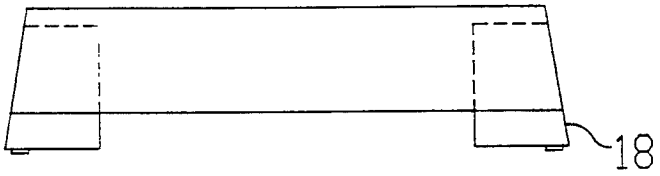
Figure 4:
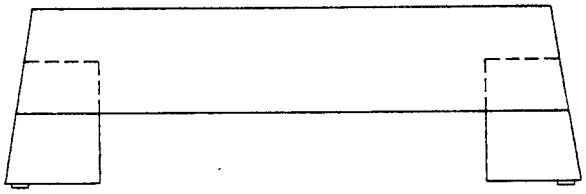
Figure 5:
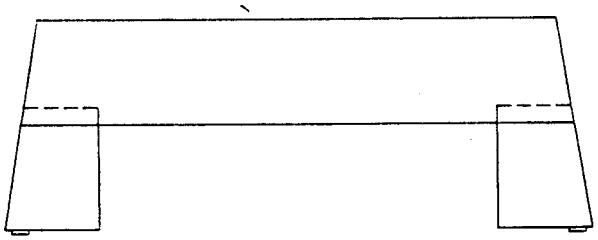
Figure 6:
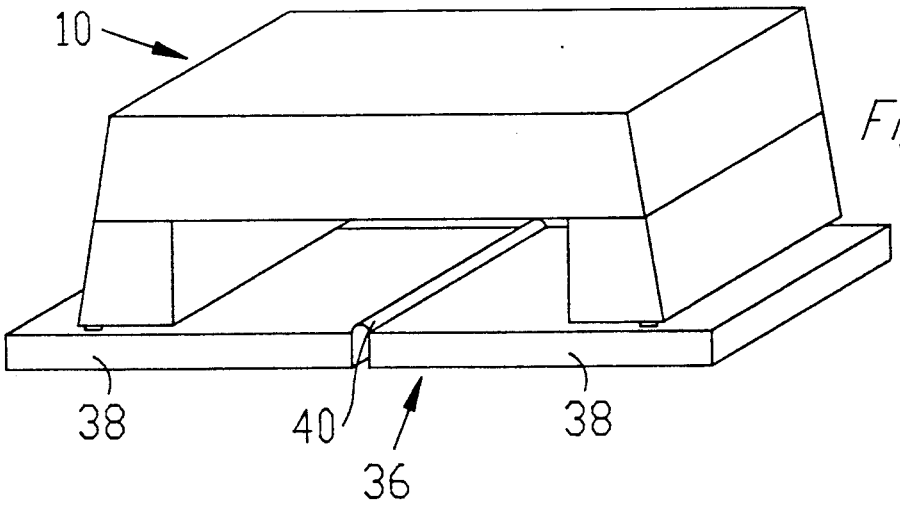
FIG. 6 is a perspective view of the device shown in FIGS. 1–5 at its maximum height.

Height adjustment is attained by selecting which of the tracks the leg ridges are mounted into. For example, FIG. 3 illustrates one elevation where each ridge 20, 22, 24 is mounted in a corresponding track 26, 28, 30 so that the legs 18 are inserted their maximum distance into base 12. FIG. 4 illustrates the next height level where ridges 20, 22 would be engaged with tracks 28, 30. FIG. 5 illustrates ridges 20 to be engaged with tracks 30 to achieve yet another height wherein the legs are extended away from platform 14 by their maximum amount.

If desired, nonskid members 34 could be provided on the surface contacting edges of apron 16 and legs 18. Similarly, a nonskid surface could be on the upper portion of platform 14.

Figure 8:
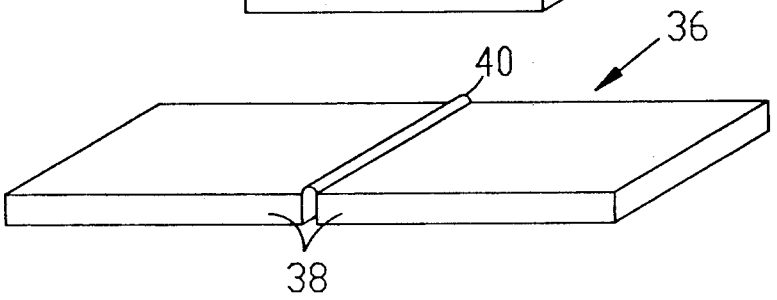
FIG. 8 is a perspective view showing the mat from FIGS. 6–7 in its opened and flat condition.

In order to achieve maximum height versatility device 10 further includes a mat 36 which preferably is made of at least two panels 38 with each set of adjacent panels connected together by a flexible hinge 40. FIG. 8 illustrates mat 36 in its opened position which would correspond to the lowest height for the exercise device wherein the base 12 and legs 18 would not be utilized.

Figure 2:
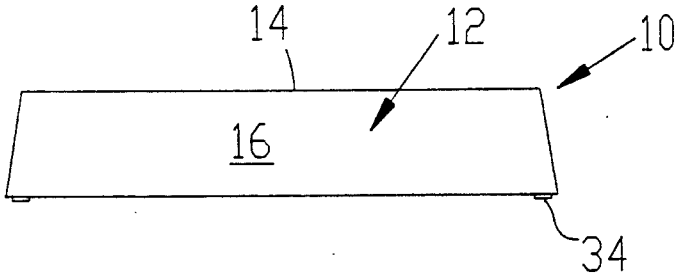
FIGS. 2–5 are front elevational views of an aerobic climbing step/bench device in accordance with this invention shown at different heights.
Figure 7:
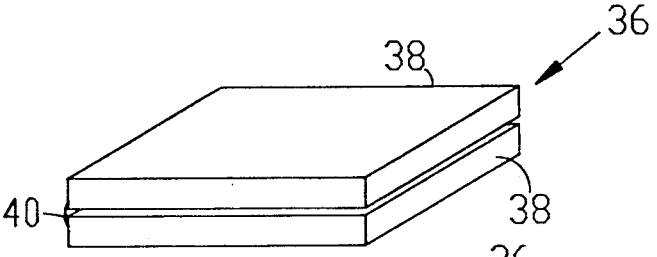
FIG. 7 is a perspective view showing the mat from FIG. 6 in its folded condition.

In one practice of this invention, mat 36 is two inches high. Platform 14 extends above the lower edge of apron 16 by a height of six inches. The various ridges are spaced two inches apart. With these dimensions it is possible to achieve a range of height adjustment from two inches to fourteen inches in two inch increments. FIG. 8, for example, shows mat 36 in its opened condition wherein a step is formed two inches high. At this height mat 36 could be a low step or a warmup mat. When mat 36 is folded over to the position shown in FIG. 7 the mat is four inches high which would correspond to the second elevation for the step. FIG. 2 illustrates the device wherein the base 12 itself is used as the step without any mat or without any legs. In FIG. 2 the step would be six inches high. Where legs 18 are mounted to base 12 and are fully inserted therein so as to extend two inches below the lower edge of apron 16 the height of the resulting step is eight inches high. FIG. 4 shows the next height of ten inches where two of the three sets of ridges are utilized for mounting purposes. FIG. 5 shows an elevation of twelve inches where legs 18 are fully extended. The final height of fourteen inches is achieved by placing the assembly of FIG. 5 on the mat 36 so as to raise platform 14 to an elevation of fourteen inches. To accomplish this, mat 36 has an area larger than the area of base 12. It is to be understood that the above dimensions are merely exemplary. For example, the invention could be practiced with a greater or lesser number of sets of ridges and tracks which are spaced apart by distances other than two inches. Such arrangement would change the height selectively. Similarly, the dimensions of mat 36 and base 12 would also affect the height adjustability.

Where mat 36 is made of two or more panels, different heights could be achieved by the degree the panels are folded atop each other, with the panels alone comprising the step or with the base be placed on the unfolded or folded mat.

Figure 9:
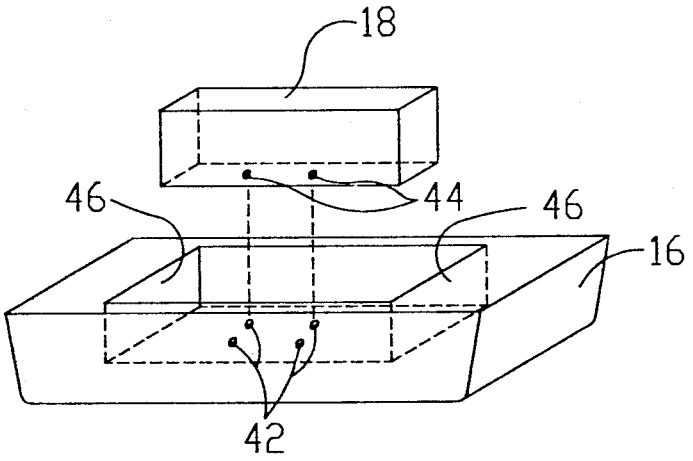
FIG. 9 is a perspective view showing the manner of storing one of the legs in the base in accordance with one embodiment of this invention.

Another advantageous feature of this invention is the ability to store the legs and mat during periods of nonuse of those components. FIG. 9, for example, illustrates base 12 to be in an inverted position. Two sets of posts 42 are provided on the under surface of platform for accommodating the corresponding holes 44 into legs 18 when each leg is moved downwardly into contact with the under surface of the inverted base 12.

FIG. 9 illustrates a variation of the invention wherein an inner apron 46 is provided with sides parallel to outer apron 16. The inner apron 46 could be dimensions for snugly receiving the two legs 18 or the folded mat 36. Mounting elements could be provided on outer surface of inner apron 46 to cooperate with corresponding mounting elements on the adjacent inner surface of apron 16. Where the legs are center mounted as in FIG. 1, the mounting elements would be on the front and back walls of apron 46 and four legs would be used. Where the legs are front mounted as later described with respect to FIG. 13, the mounting elements would be on the end walls of inner apron 46.

Figure 10:
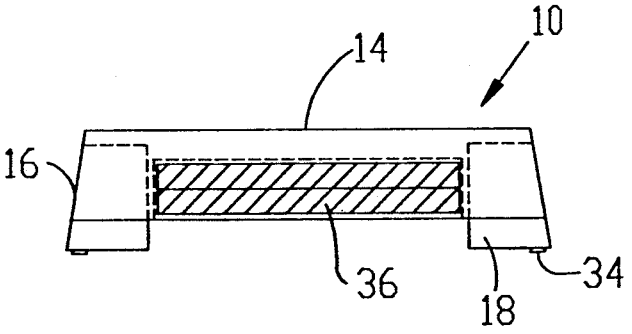
FIG. 10 is a side elevational view partly in section showing the mat of FIGS. 6–8 in a stored condition.

FIG. 10 illustrates mat 36 to be folded over and stored within the periphery of inner apron 46 during periods where the mat is not used.

Figure 11:
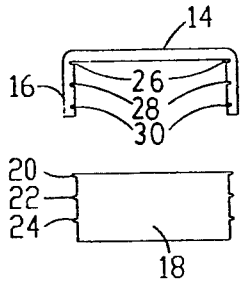
FIGS. 11–12 are end elevational views showing alternative structures for the aerobic climbing step/bench device of this invention.
Figure 12:
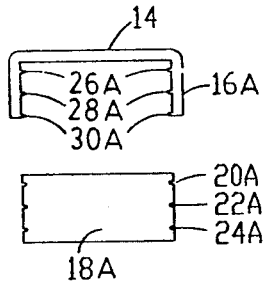

FIGS. 11–12 illustrate alternative arrangements for the complementary locking of the legs 18 to the base. As shown in FIG. 11 the legs 18 include outwardly extending ridges 20, 22, 24 while the inner surface of apron 16 includes tracks 26, 28, and 30. FIG. 12, however, illustrates leg 18A to include tracks 20A, 22A, and 24A while the ridges 26A, 28A and 30A are provided on the inner surface of apron 16A.

Figure 13:
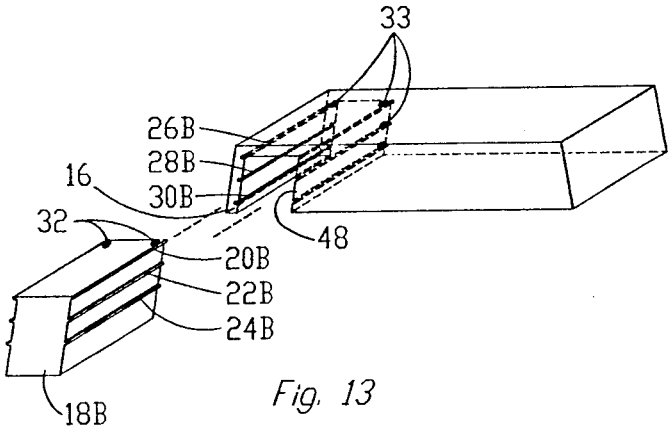
FIGS. 13–16 are perspective views showing alternative arrangements for achieving height adjustability for the aerobic climbing step/bench in accordance with alternative forms of this invention.

FIG. 13 illustrates a variation of the invention wherein the legs 18B are front mounted rather than being inserted into the center of base 12 and then being moved outwardly in the manner described with respect to FIG. 1. As illustrated in FIG. 13, legs 18B include ridges 20B, 22B, 24B which engage complementary tracks 26B, 28B, 30B along the surface of apron 16 and inner apron 48. Inner apron 48 in this embodiment is a wall parallel to one of the end walls of apron 16 so that the leg 18B may be inserted by being slid through the open area in the front wall of apron 16 with the corresponding ridges engaged in complementary tracks. A second inner apron and mounting elements would be at the opposite end of the base along with a second opening in the front of the apron. When fully inserted, leg 18B is locked in place by the projections 32B entering corresponding notches in the complementary tracks.

Figure 14:
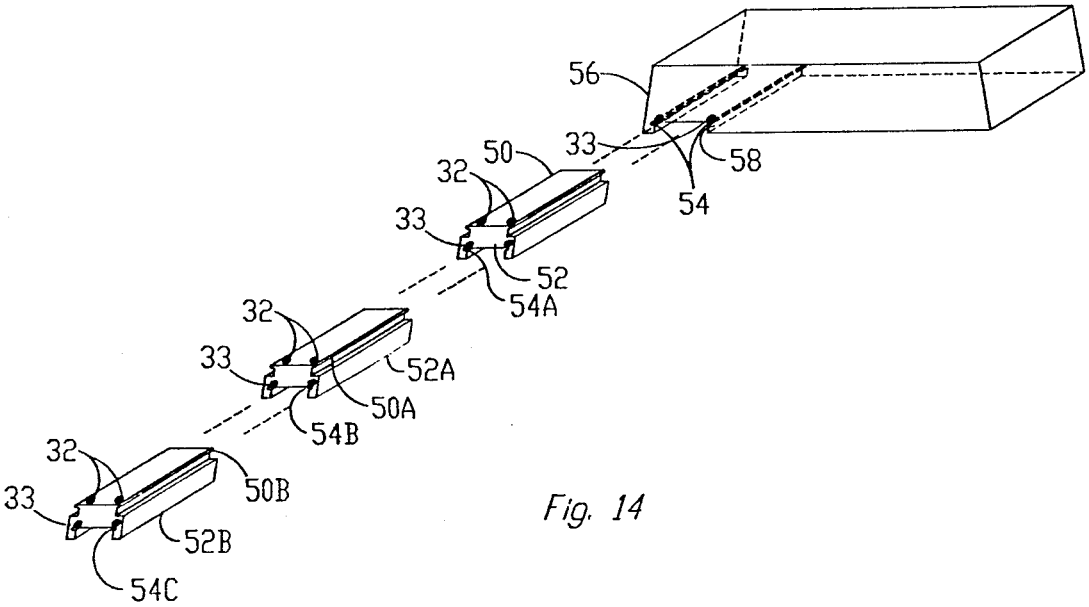

FIG. 14 illustrates a further variation of this invention wherein height adjustability is achieved by having a single set of fastening elements such as ridges 50 on leg 52. Ridges 50 engage in corresponding tracks 54 provided in outer apron 56 and inner wall 58. Leg 52 would be front mounted in the manner similar to leg 18B except that there is no selectivity for height adjustment of leg 52. In this respect, there is only a single set of tracks and a single set of ridges. Height adjustment is achieved by providing further legs 52A, 52B, etc. each of which has a set of ridges 50A, 50B, etc. for engagement in complementary tracks 54A, 54B, etc. to selectively permit any number of legs to be vertically connected together. For example, as illustrated lower leg 52B includes a track 54C for receiving yet another leg. It is to be understood that although the various figures illustrate only a single leg mounted to the respective base, the invention would be practiced by having legs at at least two spaced locations, preferably at the opposite ends of the base.

Figure 15:
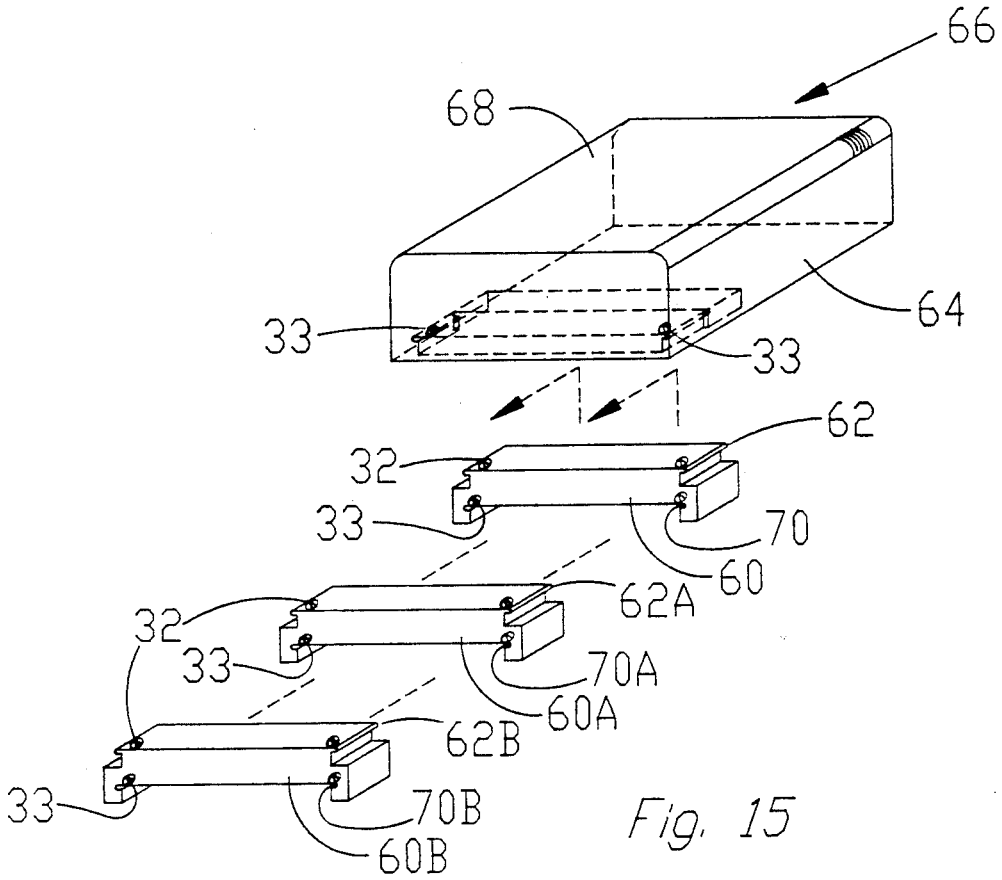

FIG. 15 illustrates a variation wherein the concepts of FIGS. 1 and FIGS. 14 are combined. In this respect, a set of legs 60, 60A, 60B, etc. are provided which include ridges 62, 62A, 62B, etc. The ridges 62 engage tracks at opposite sides of apron 64 by leg 60 being inserted in the same manner as leg 18. In this respect, leg 60 is positioned at generally the center of base 66 and moved toward platform 68 until its ridges 62 are aligned with the ridges on the inner surface of apron 64. Leg 60 is then moved outwardly with the ridges 62 sliding in the tracks until the legs are locked in place by the use of projections and notches as previously described. When further height adjustment is desired, a second leg 60A is slideably secured to leg 60 by ridges 62A engaging track 70 in leg 60. A similar locking action of a projection and notch would also be utilized to firmly lock leg 60A to leg 60. A third leg 60B could then be secured to the assembly by its ridges 62B engaging tracks 70A of leg 60A. Any number of legs could be vertically secured together in this manner.

Figure 16:
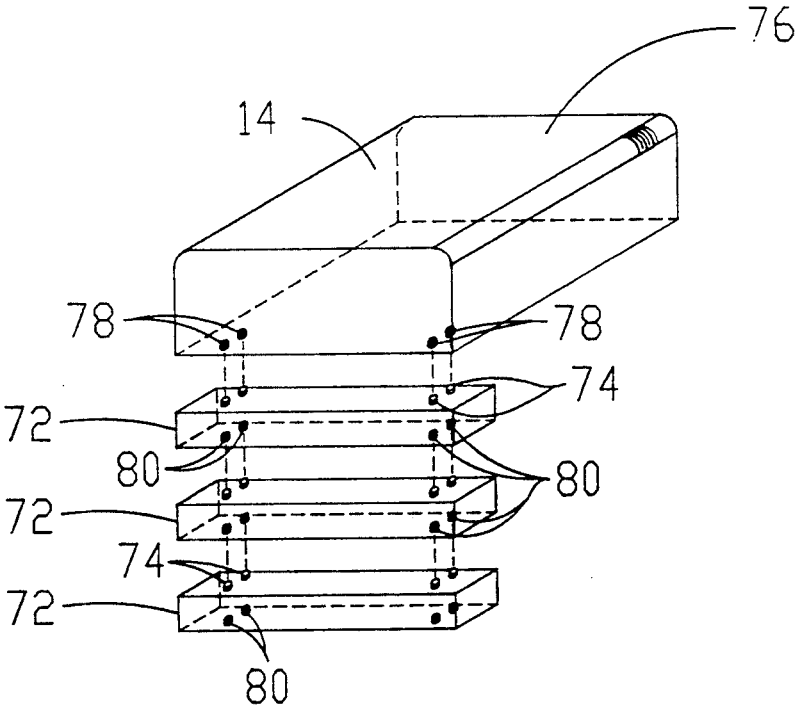

FIG. 16 illustrates a further variation of the invention wherein the legs are in the form of identical block members 72. Each block 72 includes sets of posts 74. Base 76 is formed of solid block construction and its lower surface is provided with sets of holes 78 positioned for snugly receiving posts 74 from the uppermost leg 72. Each leg in turn gets provided with holes 80 at its lower surface for receiving the posts 74 of the next adjacent lower leg 72. This manner of height adjustment is particularly advantageous since the interlocking of the posts and holes provides a positive support structure which would prevent any accidental dislodgement of legs by someone inadvertently for example kicking the assembly.

If desired base 76 may be of solid block construction only in the areas where the legs are secured to the base.

It is to be understood that each of the above described embodiments may be incorporated with other of the embodiments. For example, the inner apron may take various forms where such an inner apron is used. In one form, the inner apron may comprise a wall disposed inwardly and parallel to one of the outer apron walls which extends completely across the base. Alternatively, the inner apron may be comprised of four walls forming a closed rectangle wherein each inner wall is parallel to and spaced from a corresponding outer apron wall. The apron itself may be perpendicular to the platform or may be disposed at an angle. Likewise the inner apron would be parallel to the outer apron, either perpendicular or at an angle to the platform. The legs may generally be mounted to the base in one of two manners. In one practice a leg is center mounted by being inserted in generally the central area of the base and moved outwardly with the ridges and tracks forming complementary mounting means. In the other practice, the legs are front mounted by being inserted from the front side of the apron toward the opposite rear face. In such practice, the apron would be physically located so that the leg abuts against an apron wall even if other portions of the apron have open spaces.

Where a mat is used the base, legs and mat are dimensioned in the preferred practice of the invention to provide for storage of the mat within the base during periods of nonuse of the mat. For example, the base may be sixteen inches by thirty-two inches by six inches with the legs having a length of six inches thereby forming an open space between the legs twenty inches long. The mat itself in its opened condition would be two inches by sixteen inches by forty inches so that in its folded condition it would be twenty inches long for snugly fitting in the space between the legs.

While various embodiments have been described with respect to ridges or tracks being formed on the apron, it is to be understood that the invention may be broadly practiced by providing the ridges for tracks on the undersurface on the platform itself rather than on the apron. For example, the undersurface of the platform might be inclined so that ridges or tracks located parallel to each other at different differences to the periphery of the platform would cause different height elevations when the ridges or tracks are engaged by complementary tracks or ridges on the top surface of the legs.

What is claimed is:

1. An aerobic climbing step/bench device comprising a base, said base consisting of the horizontal platform having a periphery formed by opposite ends and intermediate sides and said base having downwardly extending sides and a bottom surface, mounting members formed in said bottom surface at two spaced locations of said base, a first set of legs for each of said locations, each of said legs having a lower surface for resting on a support surface, each of aid first set of legs having complementary mounting members for detachable engagement with said mounting members of said base whereby said platform is provided with at least two levels of height adjustability wherein said device is capable of one height level when no leg is mounted to said base and said base is placed directly on a support surface and there are other height levels in accordance with sad legs being coplanar and being parallel to said horizontal platform when said legs are mounted to said base.

2. The device of claim 1 including at least one further set of legs, said first set of legs having mounting members and each of said further sets of legs having complementary mounting members for engagement with and below said first set of legs to provide further height levels in accordance with the number of sets of legs mounted to each other.

3. The device of claim 1 wherein said mounting members and complementary mounting members are posts and holes or holes and posts which comprise dislodgement preventing means for providing a positive support structure.

4. The device of claim 3 including at least one further set of legs, said first set of legs having mounting members and each of said further sets of legs having complementary mounting members for engagement with and below said first set of legs to provide further height levels in accordance with the number of sets of legs mounted to each other.

5. The device of claim 4 wherein said posts are on the upper surface of each of said legs, and said holes being in said bottom surface of said base and in said lower surface of each of said legs.

6. The device of claim 3 wherein said posts are on the upper surface of each of said legs, and said holes being in said bottom surface of said base.

7. The device of claim 1 wherein said bottom surface of said base is a continuous surface extending from one of said ends to the other of said ends.

8. The device of claim 1 wherein said legs are spaced from each other with said base spanning the open space between said legs when said legs are mounted to said base.

9. The device of claim 1 wherein each of said legs extends completely across said base from one of said intermediate sides to the other of said intermediate sides.

10. The device of claim 1 wherein each of said sets of legs includes at least one leg for each of said locations.

11. An aerobic climbing step/bench device comprising a base, said base consisting of the horizontal platform having a periphery formed by opposite ends and intermediate sides and said base having downwardly extending sides and a bottom surface, mounting members formed in said bottom surface at two spaced locations of said base, a first set of legs for each of said locations, each of said first set of legs having complementary mounting members for engagement with aid mounting members of said base whereby said platform is provided with at least two levels of height adjustability wherein there is one height level when no leg is mounted to said base and said base is placed directly on a support surface and there are other height levels in accordance with said legs being mounted to said base, said mounting members and complementary mounting members being posts and holes or holes and posts which comprise dislodgement preventing means for providing a positive support structure, and said posts being perpendicular to said platform.

12. The device of claim 1 wherein said legs are distinct and separate from each other with an open space between said legs.

* * * * *